US011296440B2

(12) United States Patent
Moll et al.

(10) Patent No.: US 11,296,440 B2
(45) Date of Patent: Apr. 5, 2022

(54) ELECTRICAL TERMINAL FOR FLAT FLEXIBLE CABLES

(71) Applicant: TE Connectivity Services GmbH, Schaffhausen (CH)

(72) Inventors: Hurley Chester Moll, Hershey, PA (US); John Mark Myer, Millersville, PA (US); Forrest Irving Kinsey, Jr., Harrisburg, PA (US)

(73) Assignee: TE Connectivity Services GmbH (CH)

( * ) Notice: Subject to any disclaimer, the term of this patent is extended or adjusted under 35 U.S.C. 154(b) by 0 days.

(21) Appl. No.: 16/919,926

(22) Filed: Jul. 2, 2020

(65) Prior Publication Data

US 2022/0006213 A1 Jan. 6, 2022

(51) Int. Cl.
*H01R 12/69* (2011.01)

(52) U.S. Cl.
CPC ..... *H01R 12/69* (2013.01)

(58) Field of Classification Search
CPC ..... H01R 12/69
See application file for complete search history.

(56) References Cited

U.S. PATENT DOCUMENTS 4,867,700 A * 9/1989 Kreinberg ..... H01R 43/01 439/422
4,900,264 A * 2/1990 Bennett ..... H01R 12/592 439/391
4,975,080 A * 12/1990 Daly ..... H01R 12/613 29/866
4,975,081 A * 12/1990 Daly ..... H01R 11/11 439/422
6,467,164 B2 * 10/2002 Aoyama ..... H01R 12/69 29/857
7,551,448 B2 * 6/2009 Roberts ..... G01D 9/005 361/737
7,980,884 B2 * 7/2011 Kondo ..... H01R 12/592 439/422
9,225,078 B1 * 12/2015 Nelson ..... H01R 43/01
2007/0077807 A1 * 4/2007 Kumakura ..... H01R 43/048 439/422
2017/0324172 A1 * 11/2017 Myer ..... H01R 4/188

* cited by examiner

*Primary Examiner* — Jean F Duverne

(57) ABSTRACT

A cable assembly includes a flat flexible cable having a plurality of conductors embedded within an insulation material. A portion of each of the conductors is exposed via openings selectively formed in the insulation material, allowing for a crimping portion of an electrically conductive terminal to engage with the conductor within the opening. The crimping portion of the terminal includes a base defining at least one protrusion extending therefrom, and first and second sidewalls extending from the base. The base and sidewalls define an opening configured to receive the conductor therein, wherein the sidewalls are foldable into the opening for crimping the conductor within the opening and generally between the protrusion of the base and a portion of the sidewalls.

20 Claims, 8 Drawing Sheets

ELECTRICAL TERMINAL FOR FLAT FLEXIBLE CABLES

FIELD OF THE INVENTION

The present disclosure relates to electrical terminals, and more particularly, to electrical terminals suitable for crimping to conductors of a flat flexible cable.

BACKGROUND

As understood by those skilled in the art, flat flexible cables (FFCs) or flat flexible circuits are electrical components consisting of at least one conductor (e.g., a metallic foil conductor) embedded within a thin, flexible strip of insulation. Flat flexible cables are gaining popularity across many industries due to advantages offered over their traditional "round wire" counter parts. Specifically, in addition to having a lower profile and lighter weight, FFCs enable the implementation of large circuit pathways with significantly greater ease compared to a round wire-based architectures. As a result, FFCs are being considered for many complex and/or high-volume applications, including wiring harnesses, such as those used in automotive manufacturing.

The implementation or integration of FFCs into existing wiring environments is not without significant challenges. In an automotive application, by way of example only, an FFC-based wiring harness would be required to mate with perhaps hundreds of existing components, including sub-harnesses and various electronic devices (e.g., lights, sensors, etc.), each having established, and in some cases standardized, connector or interface types. Accordingly, a critical obstacle preventing the implementation of FFCs into these applications includes the need to develop quick, robust, and low resistance termination techniques which enable an FFC to be connectorized for mating with these existing connections.

A typical FFC may be realized by applying insulation material to either side of a pre-patterned thin foil conductor, and bonding the sides together via an adhesive to enclose the conductor therein. Current FFC terminals include piercing-style crimp terminals, wherein sharpened tines of a terminal are used to pierce the insulation and adhesive material of the FFC in order to attempt to establish a secure electrical connection with the embedded conductor. However, due in part to the fragile nature of the thin foil conductor material, these types of terminals have several drawbacks, including much higher electrical resistances compared to conventional round wire F-crimps, inconsistent electrical connectivity between the conductor and the terminal, and mechanical unreliability over time in harsh environments.

Accordingly, there is a need for improved electrical terminals and accompanying termination techniques for adapting FFCs to these environments.

SUMMARY

According to an embodiment of the present disclosure, a terminal for mating with an exposed conductor of a flat flexible cable is provided. The terminal includes an electrical contact and a crimping portion extending from the electrical contact in a longitudinal direction of the terminal for crimping to the conductor of the flat flexible cable. The crimping portion comprises a base defining at least one protrusion extending therefrom, and first and second sidewalls extending from the base. The base and sidewalls define an opening configured to receive the conductor of the flat flexible cable therein. The sidewalls are foldable over one another and into the opening for crimping the conductor within the opening and generally between the protrusion of the base and a portion of the sidewalls.

A cable assembly according to an embodiment of the present disclosure includes a flat flexible cable having a plurality of conductors embedded within an insulation material. A portion of each of the conductors is exposed via windows or openings selectively formed in the insulation material, allowing for a crimping portion of an electrically conductive terminal to engage with the conductor within the opening. The crimping portion includes a base defining at least one protrusion extending therefrom, and first and second sidewalls extending from the base. The base and sidewalls define an opening configured to receive the exposed conductor therein, wherein the sidewalls are foldable into the opening for crimping the conductor within the opening and generally between the protrusion of the base and a portion of the sidewalls.

BRIEF DESCRIPTION OF THE DRAWINGS

The invention will now be described by way of example with reference to the accompanying figures, of which.

DETAILED DESCRIPTION OF THE EMBODIMENT(S)

Figure 1:
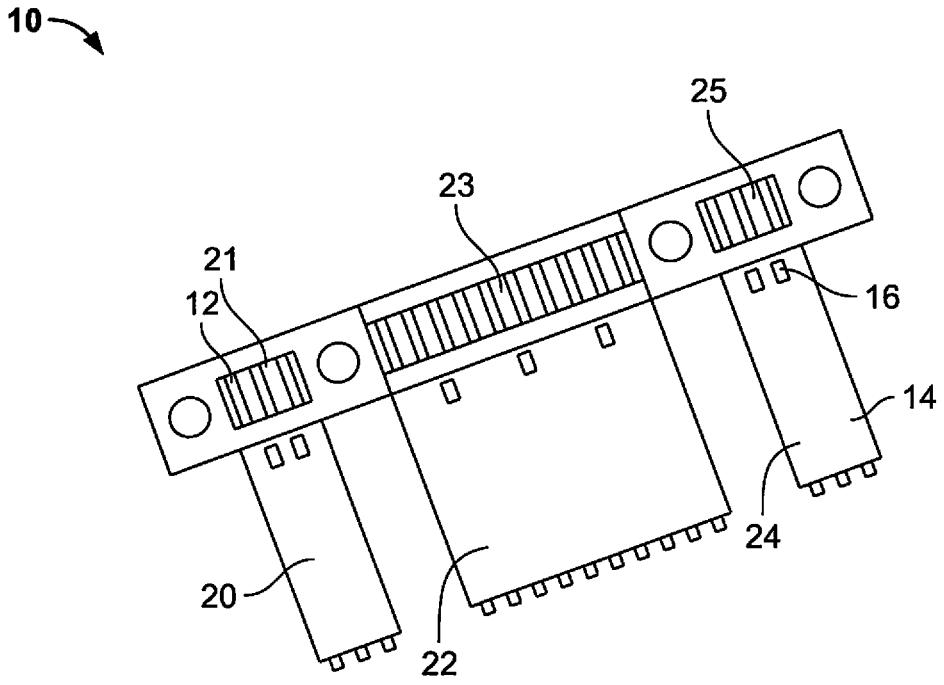
FIG. 1 is a top view of an exemplary FFC configured for use with terminals according to embodiments of the present disclosure.

Exemplary embodiments of the invention will be described hereinafter in detail with reference to the attached drawings, wherein like reference numerals refer to like elements. The invention may, however, be embodied in many different forms and should not be construed as being limited to the embodiments set forth herein; rather, these embodiments are provided so that the present disclosure will be thorough and complete, and will fully convey the concept of the disclosure to those skilled in the art.

Reliably crimping a terminal onto a thin conductor of an FFC requires a means to address the risks of either failing to make suitable (or any) electrical contact with the conductor, or damaging the conductor via the application of excess pressure. This has proven difficult to achieve, in part due to the thin nature of the conductors of the FFC compared to the tolerances of typical crimp-style terminals. For example, with a thickness of less than a tenth of a millimeter (mm) (e.g., 0.07 mm), crimping height tolerances can easily exceed the thickness of the conductor, which may result in either a complete lack of electrical contact between the terminal and the conductor, or the crushing and destruction of the conductor, despite a proper crimping operation. As will be set forth in greater detail herein, embodiments of the present disclosure aim to address these difficulties, providing crimpable terminals that enable reliable, low-resistance connections to be realized in mass termination or crimping operations.

Terminals according to embodiments of the present disclosure may be configured for use with an FFC, such as the exemplary portion of an FFC 10 shown in FIG. 1. As illustrated, the FFC 10 generally includes a plurality of conductors 12 embedded within an insulation material 14. The conductors 12 may comprise metallic foil, such as copper foil on the order of 0.07 mm in thickness, by way of example only, patterned in any desirable configuration. The insulation material 14, such as a polymer insulation material, may be applied to either side of the conductors 12 via an adhesive material, resulting in an embedded conductor arrangement. The exemplary FFC 10 includes multiple segments 20,22,24, each containing a plurality of conductors 12. Respective windows or openings 21,23,25 are selectively formed or defined proximate respective ends of the segments 20,22,24 for exposing the conductors 12, enabling connectorization thereof utilizing terminals according to embodiments of the present disclosure. Windows or openings may be formed in the insulation material 14 in any desired location in order to expose portions of the conductors 12 for facilitating termination. Additional openings 16 may be provided, and configured to accept complementary features of associated connectors, as will be described in further detail herein.

Figure 2:
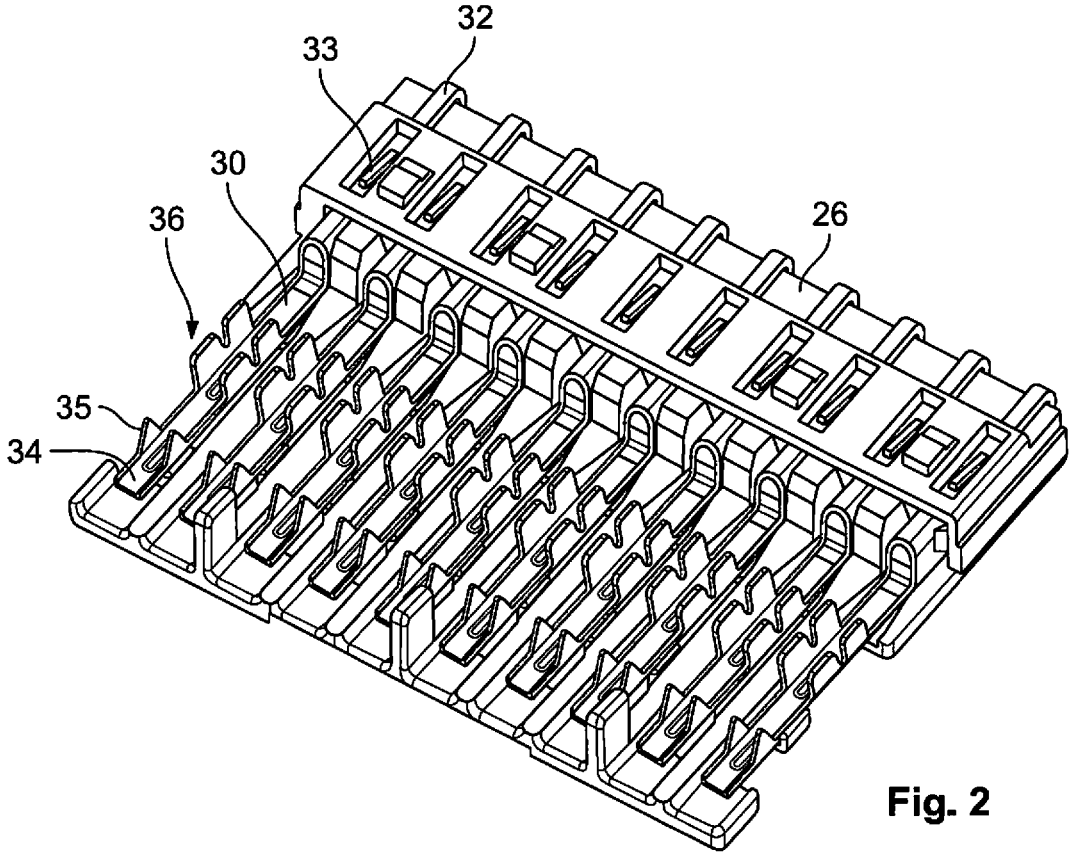
FIG. 2 is a perspective view of a plurality of terminals according to embodiments of the present disclosure installed in an exemplary connector body.

With reference to FIG. 2, an exemplary inner housing 26 forming a part of a connector is provided for fixing to the FFC 10 of FIG. 1, by way of example only. As shown, the inner housing 26 is pre-fitted with a plurality of conductive terminals 30 according to embodiments of the present disclosure. Each terminal 30 generally includes an electrical contact or mating end 32, in this case, a female mating end configured to receive a corresponding male terminal for establishing an electrical connection. The mating end 32 may comprise one or more locking features 33 configured to engage with the inner housing 26 for securing the terminal 30 thereto. A rear end 34 of the terminal 30 opposite the mating end 32 may include piercing elements 35, embodied herein as a pair of sharpened tines. Arranged between the mating end 32 and the rear end 34 is a crimping portion 36 configured to be plastically deformed to crimp onto a conductor arranged therein.

Figure 3:
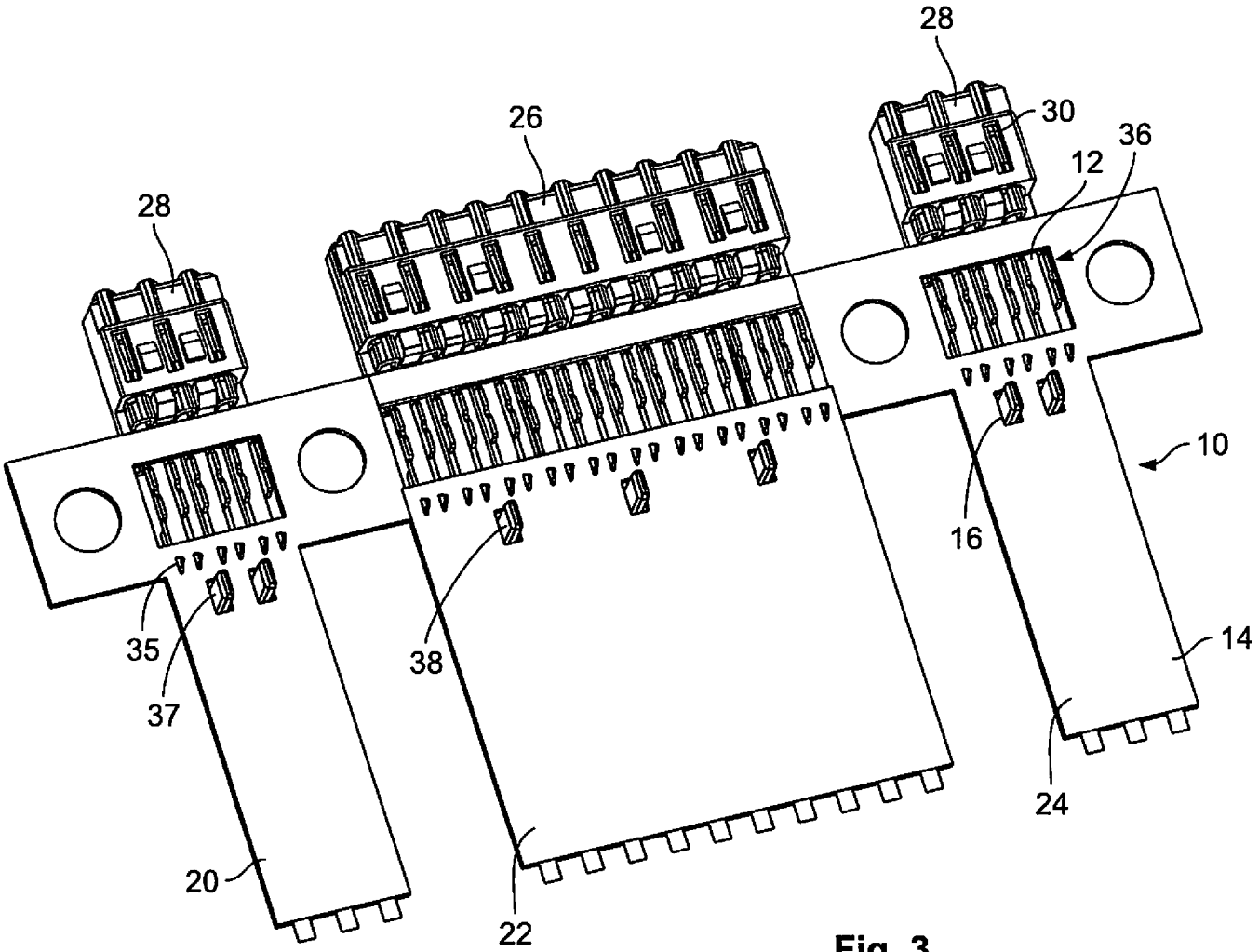
FIG. 3 is a perspective view of the FFC of FIG. 1 being mated with the terminals and connector body of FIG. 2.

FIG. 3 illustrates an intermediate step in a connectorization process of the FFC 10. As shown, the FFC 10 is placed over a plurality of connectors, including inner housing 26 of FIG. 2, as well as two second inner housings 28. The terminals 30 of each of the connectors receive the exposed conductors 12 within respective crimping portions 36 thereof which extend through the windows 21,23,25 (see FIG. 1) formed in the insulation material 14 of the FFC 10. The crimping portions 36 are configured to be crimped onto the conductors 12, for example, in a mass termination or crimping step wherein the crimping portions 36 of each of the terminals 30 is crimped simultaneously, securing the terminals 30, and thus the inner housings 26,28 to the FFC 10. The inner housings 26,28 may further define strain relief portions 37,38 configured to extend through the openings 16 in the FFC 10, which are used to further secure the inner housings 26,28 to the FFC 10. Likewise, as shown, the piercing elements 35 penetrate the insulation material 14 of the FFC 10, and may be flattened or otherwise deformed thereafter for further securing the terminal 30 to the FFC 10. In this way, the piercing elements 35 and the strain relief portions 37,38 provide forms of strain relief for the resulting connection, mechanically fixing the position of the FFC 10 relative to the terminals 30.

Figure 4A:
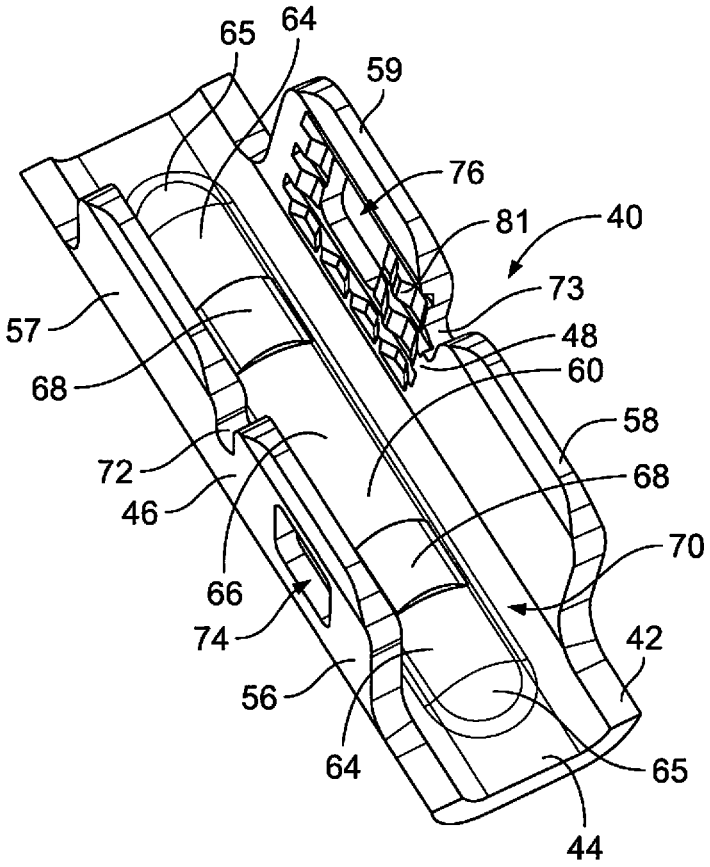
FIG. 4A is a perspective view of a crimping portion of a terminal according to a first embodiment of the present disclosure in an uncrimped state.
Figure 4B:
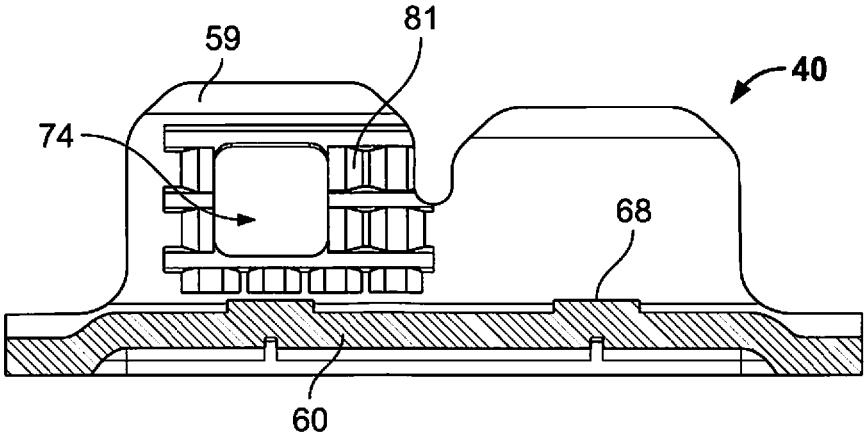
FIG. 4B is a side cross-sectional view of the crimping portion of FIG. 4A.
Figure 4C:
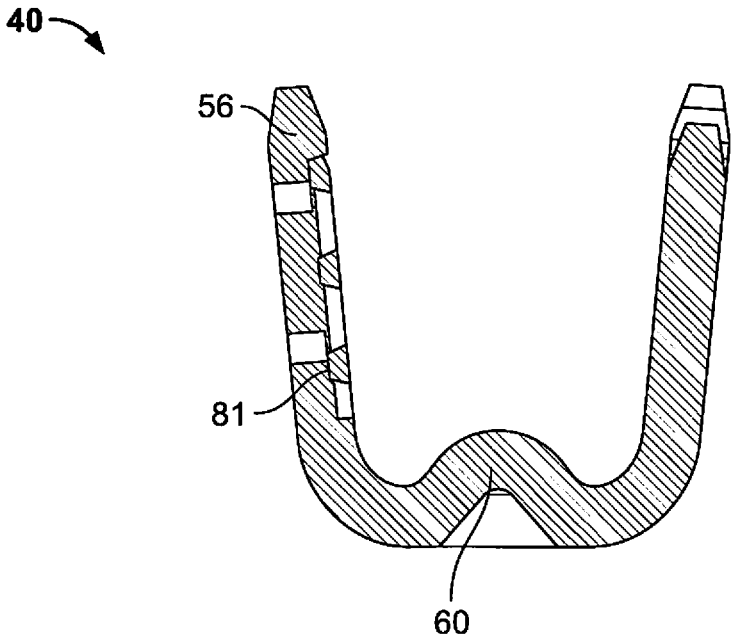
FIG. 4C is a front cross-sectional view of the crimping portion of FIGS. 4A and 4B.

FIGS. 4A-4E illustrate an embodiment of a crimping portion 40 of a terminal (e.g., terminal 30 of FIGS. 2 and 3) configured for use with an FFC according to the present disclosure, with a remainder of the terminal not shown. Referring to FIGS. 4A-4C, in an uncrimped state, the crimping portion 40 comprises a generally U-shaped body 42, including a base 44 and two generally opposing sidewalls or wings 46,48 extending from either side thereof in a direction generally perpendicularly from the base 44. A contact or conductor receiving opening or space 70 is defined between the sidewalls 46,48 and is configured to receive an exposed conductor of an FFC (e.g., conductor 12 shown in FIGS. 1 and 3) therein along an axial direction of the terminal. Each sidewall or wing 46,48 may be defined by two sections. Specifically, the sidewall 46 comprises a first section 56 and a second section 57 arranged adjacent to the first section. The first and second sections 56,57 may be uniformly continuous with one another, or may be divided and separated from one another, either fully or partially. For example, a recess or relief 72 may be defined through an intermediate portion of the sidewall 46, wherein the sections 56,57 reside on respective sides of the recess 72. The recess 72 is configured, in part, to facilitate a degree of independent motion between the first and second sections 56,57 during a crimping process. Likewise, a cut or break may be formed fully through the sidewall 46, separating the first and second sections 56,57 into discrete tabs moveable completely independently from one another. In the illustrated embodiment, the first and second sections 56,57 comprise differing overall heights, with the first section 56 being taller than the second section 57. Likewise, the second sidewall 48 comprises first and second sections 58,59, delineated by a recess 73 defined at least partially therebetween. The first and second sections 58,59 may also comprise differing heights, wherein the first section 58 is shorter in height compared to the second section 59. In this way, for each pair of opposing sidewall sections 56,58 and 57,59, one of the sidewalls has a height which is greater than the other opposing sidewall. This arrangement facilitates crimping the sidewalls in an overlapping manner, as set forth in detail herein.

As shown in FIG. 4A, an underside of the second section 59 includes a section 81 defining serrations formed therein. The serrations are provided for further improving engagement with a conductor, both by potentially increasing contact surface area, as well as by enabling the second section 59 to electrically engage with the conductor despite the presence of any foreign materials, such as remnants of the insulation or adhesive which may remain on the exposed conductor after formation of the window or opening thereabout. Another serrated section 81 is formed on an underside of the first sidewall section 56, as shown in FIG. 4C. It should be understood that these serrations may be formed on any and all surfaces of the crimping portion 40 without departing from embodiments of the present disclosure. The crimping portion 40 further includes openings or apertures 74,76 formed through at least one section of at least one sidewall thereof. In the illustrated embodiment shown in FIGS. 4A-4D, the first section 56 of the first sidewall 46 and the second section 59 of the second sidewalls 48 each comprise a respective aperture 74,76 formed therethrough. In a particularly advantageous embodiment, the apertures 74,76 are formed through the serrated sections 81 of each sidewall.

Figure 4D:
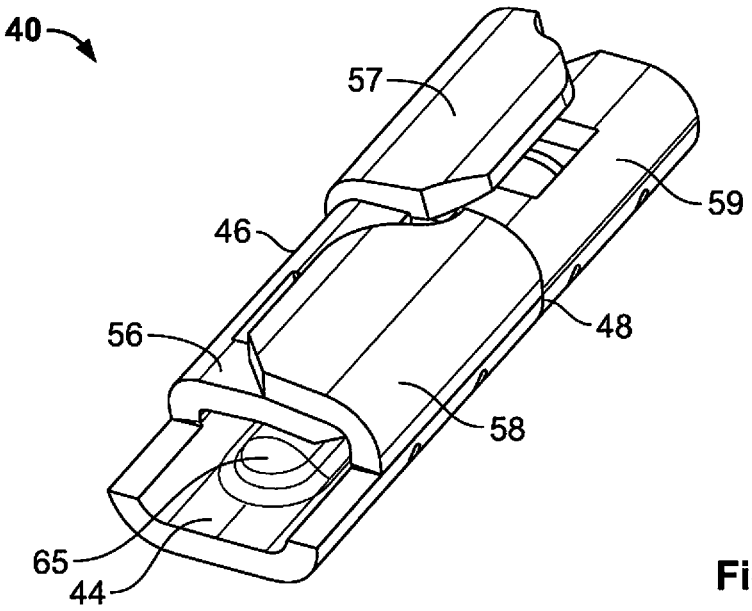
FIG. 4D is a perspective view of the crimping portion of FIGS. 4A-4C in a crimped state.
Figure 4E:
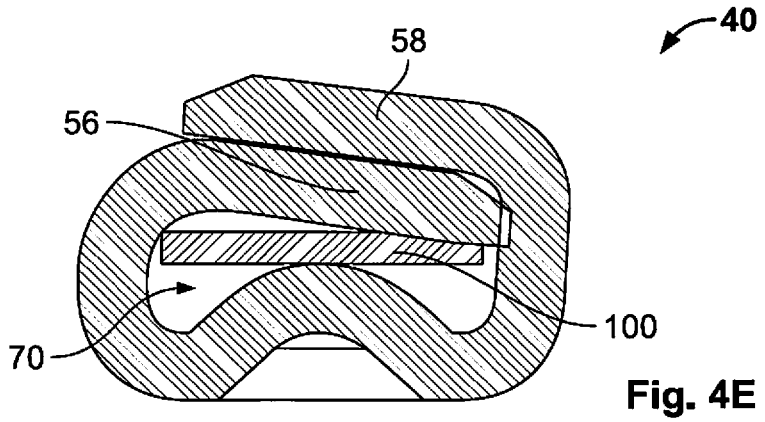
FIG. 4E is a front cross-sectional view of the crimping portion of FIG. 4D.

Referring to FIG. 4D, the crimping portion 40 is shown in a crimped state, wherein the opposing sidewalls 46,48 have been crimped or deformed from the orientation shown in FIG. 4A, into a generally parallel or crimped position with respect to the base 44. Sidewalls 46,48 may be folded or crimped in a sequential manner, with one complete sidewall 46,48 being deformed into a crimped position first, followed by the other one complete sidewall 46,48 being folded thereover (not shown). In the embodiment of FIG. 4D, however, a staggered overlapping of the sidewalls 46,48 is performed during a crimping operation, evening the distribution of forces on a conductor crimped within the terminal (not shown), and promoting a centralized position thereof within the receiving space 70. More specifically, in one embodiment, the first section 56 of the first sidewall 46 is folded into a crimped position and into contact with a conductor arranged within the receiving space 70. The second section 59 of the second sidewall 48 is also folded into a crimped position, and into contact with the conductor. Subsequently, the first section 58 of the second sidewall 48 and the second section 57 of the first sidewall 46 are folded or crimped over the respective first and second sections 56,58, holding them in contact with a conductor arranged within the terminal. FIG. 4E provides an exemplary cross-sectional view of a crimped state of the crimping portion 40, including a conductor 100 crimped within the receiving space 70.

As set forth above, reliably crimping to a thin conductor of an FFC requires a means to address the risks of either failing to make suitable electrical contact with the conductor, or damaging the conductor via the application of excess pressure. Embodiments of the present disclosure address this problem via the introduction of several additional features onto or into the base 44 of the crimping portion 40 to prevent either of the above failures.

Still referring to FIGS. 4A-4E, the crimping portion 40 includes an axially-extending protrusion 60 rising into the receiving opening 70 from the base 44. In the illustrated embodiment, the protrusion 60 includes a plurality of segments, including a pair of outer compression limiters 64 defined by raised protrusions extending from the base 44 in a vertical direction into the receiving opening 70. Likewise, a central compression limiter 66 is defined by a protrusion extending generally between the outer compression limiters 64. In the illustrated embodiment, each of the compression limiters comprises an outer curved or rounded profile having an axis of curvature aligned generally parallel with an axial direction of the terminal and/or the conductor to be arranged therein. The outer compression limiters 64 also comprise rounded ends 65 extending in respective axial directions. As shown in FIG. 4A-4D, at least a portion of each of the outer compression limiters 64 extends in an axial direction beyond an end of the first and second sidewalls 46,48, ensuring maximum contact area with a conductor crimped within the terminal.

Due in part to their curved nature, the compression limiters are configured (i.e., are sized and shaped) so as to compress a conductor under force from the crimped first and second sidewalls in a manner which will prevent damage thereto. Moreover, the added height of the compression limiters ensures that reliable electrical contact is always achieved with the conductor, addressing the above-described tolerance-related issues with crimping solutions of the prior art. Further, the height of the compression limiters may be selected so as to allow for crimp height and compressive force adjustments for a given application (e.g., for different thicknesses of conductors).

Still referring to FIGS. 4A-4E, the protrusion 60 further comprises protruding sections or pushers 68 formed between the outer compression limiters 64 and the central compression limiter 66. Each protruding section 68 may also comprise a curved or rounded profile extending into the receiving opening 70 and having an axis of curvature oriented parallel to the axial direction of the terminal. In one embodiment, the protruding sections 68 are taller than the compression limiters 64,66, and thus extend further vertically into the receiving opening or space 70. Each protruding section 68 defines at least two edges on a top surface of the protrusion 60 that extend in a direction transverse to the axial direction of the terminal. Despite the variation in height, the protruding sections 68 and the compression limiters 64,66 create a generally continuous rounded protrusion 60 extending axially within the receiving opening 70, as shown in FIG. 4B.

The apertures 74,76 formed through the first and second sidewalls 46,48 are positioned so as to correspond in location with the protruding sections 68 when the crimping portion 40 is in a crimped state, as shown in FIG. 4D. The apertures 74 aid in achieving strong electrical contact with a conductor crimped within the terminal. More specifically, as the conductor is crimped, force exerted by the protruding sections 68 on the base side of the crimping portion 40 will act to force the conductor (e.g., a conductive foil) into the apertures 74,76 (see FIG. 4E), engaging sharp perimeter edges of the apertures, as well as the edges of the protruding sections 68, with the conductor for pinching the conductor between the edges of the apertures and the edges of the protruding portions. This conductor-to-edge interaction breaks oxides and other contaminants on the conductor for improved electrical contact, and, at least in part due to the plastic deformation of the conductor, the engagement is retained even after initial crimping pressure is released.

Referring generally to FIGS. 5-11, additional embodiments of the present disclosure are shown. It should be understood that each of the embodiments of FIGS. 5-11 comprise features similar to those set forth above with respect to FIGS. 4A-4E, including like sidewall arrangements. Accordingly, the following description will focus only on the relevant departures from the above-described embodiments.

Figure 5:
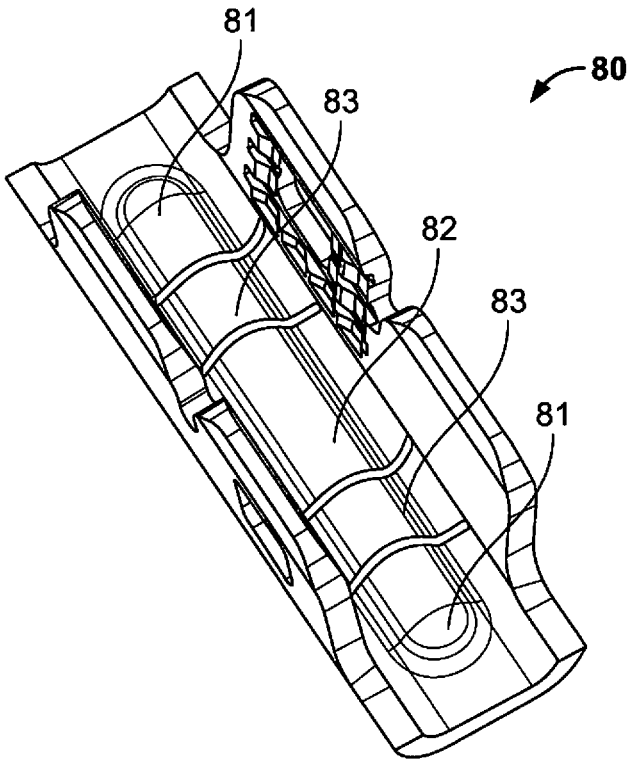
FIG. 5 is a perspective view of a crimping portion of a terminal according to a second embodiment of the present disclosure.
Figure 6:
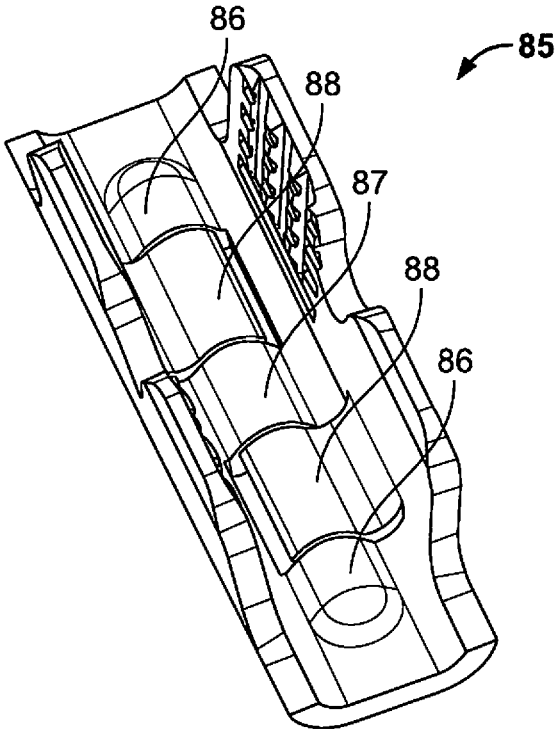
FIG. 6 is a perspective view of a crimping portion of a terminal according to a third embodiment of the present disclosure.

Referring to the embodiment of FIG. 5, a crimping portion 80 is shown having three compression limiters, including a pair of outer compression limiters 81 defined by raised protrusions extending from the base and into the receiving opening. Likewise, a central compression limiter 82 is defined by a protrusion extending generally between the outer compression limiters 81, similar to the embodiment of FIGS. 4A-4E. Between the outer compression limiters 81 and the central compression limiter 82 are arranged spring sections 83, which may be embodied as leaf springs formed in the base. Each spring section 83 may also comprise a curved or rounded profile extending into the receiving opening of the terminal and have an axis of curvature extending parallel to the axial direction of the terminal. In one embodiment, a radius of curvature of the spring sections 83 generally matches that of the compression limiters 81,82. As shown, gaps or voids are formed through the base between the spring sections 83 and compression limiters 81,82, allowing for their independent deflection or deformation. The spring sections 83 are configured (i.e., sized and shaped) so as to ensure an upward pressure is maintained on a conductor crimped within the terminal, further improving electrical contact with an engaged sidewall of the crimping portion 80. Similarly, in the embodiment of FIG. 6, a crimping portion 85 includes three compression limiters 86,87 having features similar to those described above of respect to FIG. 5. However, a pair of spring sections 88 are embodied as cantilevered springs, each having a free end and a fixed end attached to a respective sidewall for providing additional elasticity.

Figure 7:
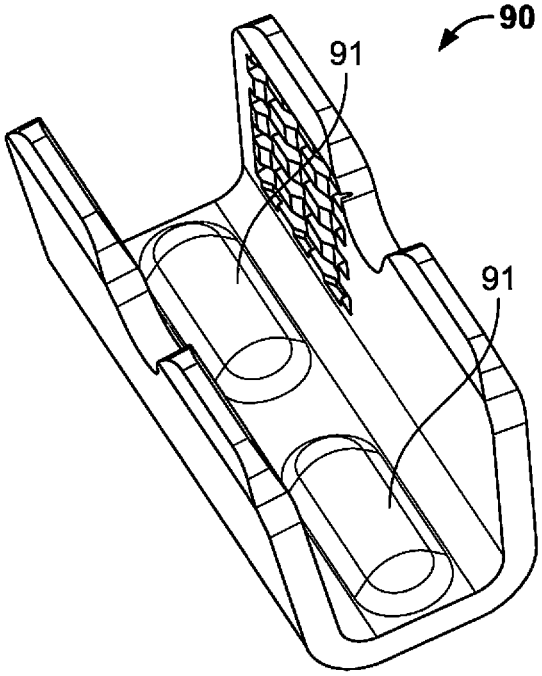
FIG. 7 is a perspective view of a crimping portion of a terminal according to a fourth embodiment of the present disclosure.
Figure 8:
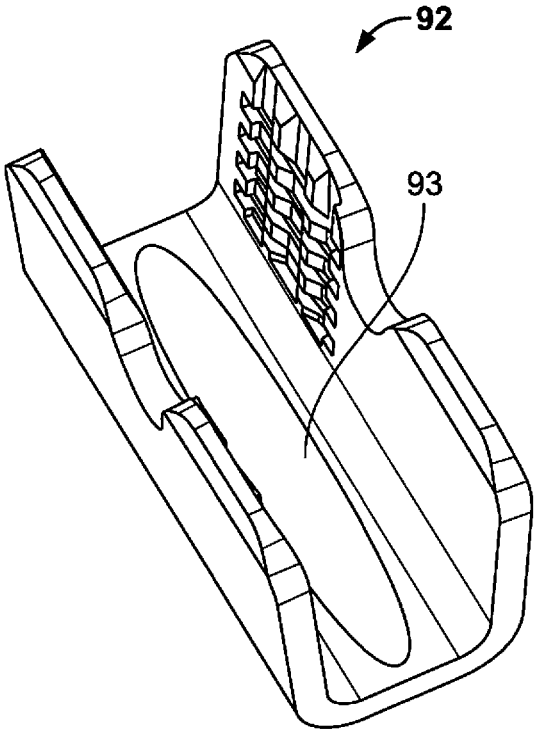
FIG. 8 is a perspective view of a crimping portion of a terminal according to a fifth embodiment of the present disclosure.

Referring generally to FIG. 7, a crimping portion 90 includes two compression limiters 91 embodied as rounded, elongated protrusions each extending in an axial direction of the terminal. Similarly, in the embodiment of FIG. 8, a crimping portion 92 comprises a compression limiter 93 embodied as a single elongated protrusion extending in an axial direction of the terminal. The compression limiter 93 is tapered in all directions and defines no planar surfaces.

Figure 9:
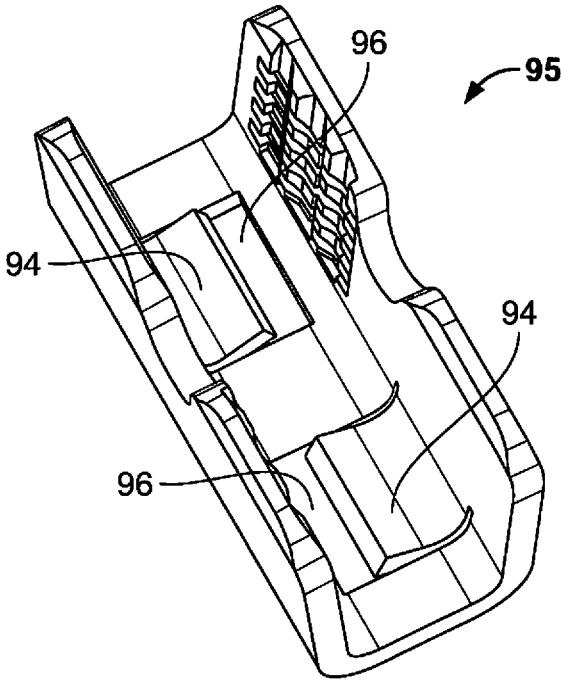
FIG. 9 is a perspective view of a crimping portion of a terminal according to a sixth embodiment of the present disclosure.

In the embodiment of a crimping portion 95 shown in FIG. 9, two cantilevered protrusions 94 extend from respective sidewalls and at least partially into respective apertures 96 formed through a base of the crimping portion. Free ends of each protrusion 94 may be bent upwards, or formed upwardly, so as to extend into the receiving opening of the terminal. In this way, the protrusions 94 function in a similar manner to the above-described compression limiters, as well as the spring portions. Moreover, the exposed edges of the protrusions 94 are configured to engage with a conductor in a crimped state for improving the reliability of the electrical connection.

Figure 10:
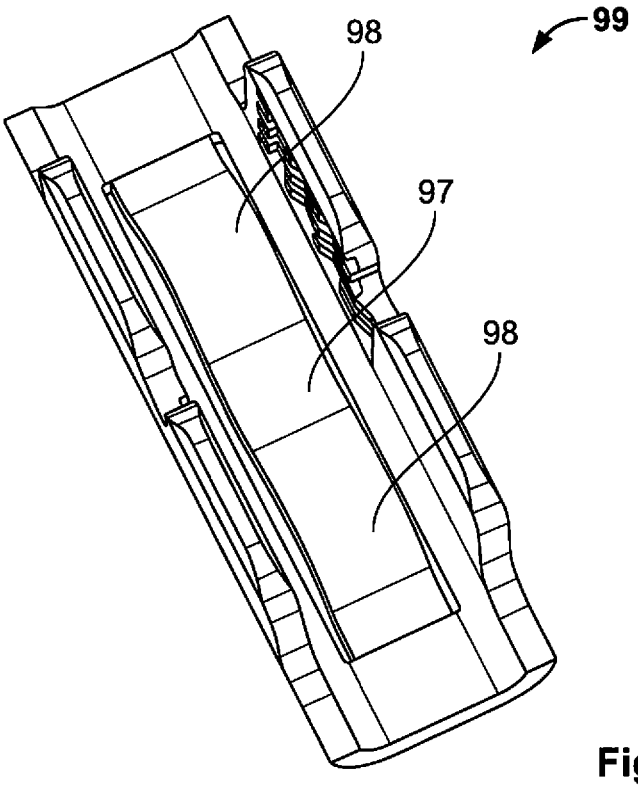
FIG. 10 is a perspective view of a crimping portion of a terminal according to a seventh embodiment of the present disclosure.
Figure 11:
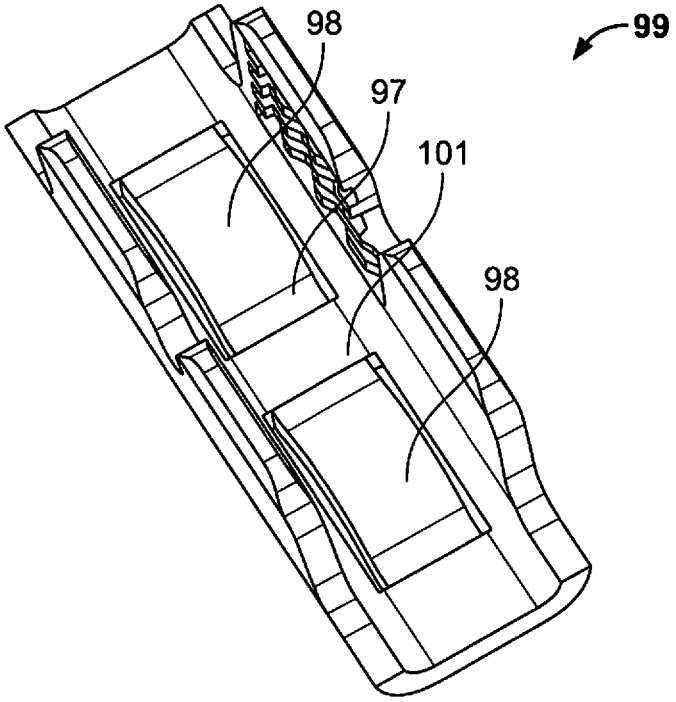
FIG. 11 is a perspective view of a crimping portion of a terminal according to an eighth embodiment of the present disclosure.

FIG. 10 illustrates an embodiment of a crimping portion 99 having a spring 97 formed in or affixed to the base. As shown, the spring 97 defines an undulating surface extending in an axial direction. Specifically, the spring 97 includes curved, raised spring sections 98 each having an axis of curvature oriented generally transverse to an axial direction of the terminal. The spring sections 98 are continuous with one another and unsupported between respective first and second ends of the spring 97. In one embodiment, the spring 97 may comprise a discrete element which is attached to a base of the terminal, for example, by inserting free ends thereof into respective openings formed in the base. In another embodiment, the spring 97 is formed integrally with the base. The embodiment of FIG. 11 comprises features similar to those of FIG. 10, however, the spring 97 is supported at an intermediate position generally between the spring sections 98 by a brace or bracket 101 extending transversely with respect to a longitudinal axis of the spring and/or the terminal. As shown, the spring sections 98 of the embodiments of FIGS. 10 and 11 extend into the receiving space and are generally aligned with the sidewalls, so as to aid in compressing a conductor arranged within the receiving space into electrical contact with an underside of the sidewalls in a crimped state of the terminal.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range. For example, it should also be understood that embodiments of the present disclosure may include any combination of the above-described features, such as various combinations of compression limiters and spring arrangements, and are not limited to the exemplary arrangements set forth in the figures.

Also, the indefinite articles "a" and "an" preceding an element or component of the invention are intended to be nonrestrictive regarding the number of instances, that is, occurrences of the element or component. Therefore "a" or "an" should be read to include one or at least one, and the singular word form of the element or component also includes the plural unless the number is obviously meant to be singular.

The term "invention" or "present invention" as used herein is a non-limiting term and is not intended to refer to any single embodiment of the particular invention but encompasses all possible embodiments as described in the application.

What is claimed is:

1. An electrical terminal for mating with an exposed conductor of a flat flexible cable, comprising:

an electrical contact; and a conductive crimping portion extending from the electrical contact in a longitudinal direction of the terminal for crimping to the conductor of the flat flexible cable, the crimping portion including:

a conductive base defining at least one protrusion extending therefrom; and first and second conductive sidewalls extending from the base, the base and sidewalls defining an opening extending in the longitudinal direction for receiving the conductor, each of the sidewalls being foldable relative to the base along a respective axis extending in the longitudinal direction and into the opening for crimping the conductor within the opening and generally between the protrusion of the base and at least a portion of the sidewalls.

2. The electrical terminal of claim 1, wherein the protrusion extends along the base in the longitudinal direction of the terminal.

3. The electrical terminal of claim 2, wherein the protrusion comprises a curved profile having an axis of curvature extending in the longitudinal direction of the terminal.

4. The electrical terminal of claim 3, wherein the protrusion comprises a first section extending into the opening a first distance, and a second section extending into the opening a second distance greater than the first distance.

5. The electrical terminal of claim 4, wherein at least one of the first or second sidewalls comprises an aperture formed therethrough in a direction transverse to the longitudinal direction, wherein in a crimped state of the crimping portion, the second section of the protrusion is configured to at least one of align or engage with the aperture.

6. The electrical terminal of claim 5, wherein the second section of the protrusion defines at least first and second edges extending in a direction transverse to the longitudinal direction of the terminal and configured to engage with the conductor arranged within the opening.

7. The electrical terminal of claim 3, wherein the protrusion comprises:

first and second end protrusions;

a central protrusion arranged between the first and second end protrusions;

a first intermediate protrusion arranged between the first end protrusion and the central protrusion; and a second intermediate protrusion arranged between the second end protrusion and the central protrusion, wherein the first and second intermediate protrusions extend further into the opening than the first and second end protrusion and the central protrusion.

8. The electrical terminal of claim 7, wherein the first and second intermediate protrusions are configured to engage with a respective aperture formed in the first sidewall and second sidewall in a direction transverse to the longitudinal direction when the crimping portion of the terminal is in a crimped state.

9. The electrical terminal of claim 1, wherein the first sidewall comprises a first section and a second section, and the second sidewall comprises a first section and a second section opposing the first and second sections of the first sidewall, wherein a recess is formed through each of the first and second sidewalls between the first section and the second section.

10. The electrical terminal of claim 9, wherein in a crimped state, the first section of the second sidewall is folded over and overlaps the first section of the first sidewall, and the second section of the first sidewall is folded over and overlaps the second section of the second sidewall.

11. The electrical terminal of claim 10, wherein the first and second sections of each sidewall comprise different heights.

12. The electrical terminal of claim 11, wherein opposing first sections of the first and second sidewalls comprise different heights.

13. The electrical terminal of claim 10, wherein at least one of the first section of the first sidewall or the second section of the second sidewall comprises a serration on a side thereof facing the opening.

14. The electrical terminal of claim 13, wherein at least one of the first section of the first sidewall or the second section of the second sidewall comprises an aperture formed therethrough in an area of the serration and in a direction transverse to the longitudinal direction.

15. The electrical terminal of claim 14, wherein at least a portion of the protrusion is configured to at least one of align or engage with the aperture when the crimping portion is in a crimped state.

16. A cable assembly including:

a flat flexible cable including a plurality of conductors embedded within an insulation material, wherein a portion of each of the conductors is exposed via openings selectively formed in the insulation material; and a plurality of electrically conductive terminals, each of the terminals having a conductive crimping portion at least partially engaging with the openings in the insulation material and receiving the exposed portion of a respective conductor, the crimping portion including:

a conductive base defining at least one protrusion extending therefrom; and first and second conductive sidewalls extending from the base, the base and sidewalls defining an opening configured to receive the conductor therein, the sidewalls extending through one of the openings formed in the insulation material and being foldable into the opening for crimping the conductor within the opening and generally between the protrusion of the base and a portion of the sidewalls.

17. The cable assembly of claim 16, wherein the protrusion comprises a curved profile having an axis of curvature extending in a longitudinal direction of the terminal.

18. The cable assembly of claim 17, wherein the protrusion comprises a first section extending into the opening a first distance, and a second section extending into the opening a second distance greater than the first distance.

19. The cable assembly of claim 18, wherein at least one of the first or second sidewalls comprises an aperture formed therethrough, wherein in a crimped state of the crimping portion, the second section of the protrusion is configured to at least one of align or engage with the aperture.

20. The cable assembly of claim 17, wherein the protrusion comprises:

first and second end protrusions;

a central protrusion arranged between the first and second end protrusions;

a first intermediate protrusion arranged between the first end protrusion and the central protrusion; and a second intermediate protrusion arranged between the second end protrusion and the central protrusion, wherein the first and second intermediate protrusions extend further into the opening than the first and second end protrusion and the central protrusion.

* * * * *